US005802778A

United States Patent [19]

Thorp et al.

[11] Patent Number: 5,802,778

[45] Date of Patent: Sep. 8, 1998

[54] WORKSTATION WITH FLEXIBLE CANOPY

[75] Inventors: Clarkson S. Thorp, Wayland; Thai Q. Tran; Gary R. Ludwig, both of Holland; Steven A. Heyer, Jenison, all of Mich.

[73] Assignee: Haworth, Inc., Holland, Mich.

[21] Appl. No.: 660,503

[22] Filed: Jun. 7, 1996

[51] Int. Cl.[6] ..... E04H 1/12

[52] U.S. Cl. ..... 52/36.2; 52/66; 52/70; 52/71; 52/72; 52/79.4

[58] Field of Search ..... 52/36.1, 36.2, 52/71, 72, 70, 79.1, 79.4, 66, 239; 135/117, 87, 151, 154, 155, 143, 147, 97; 312/223.3, 3, 249.8, 329

[56] References Cited

U.S. PATENT DOCUMENTS

| | | | |
|---|---|---|---|
| 688,008 | 12/1901 | Rosa | 52/71 |
| 756,091 | 3/1904 | Altick | 52/71 |
| 1,493,915 | 5/1924 | Baker | 135/151 X |
| 2,162,523 | 6/1939 | Blood et al. | 52/71 X |
| 3,841,037 | 10/1974 | Clark | 52/36.1 |
| 4,471,586 | 9/1984 | Schuch et al. | 52/36.2 |
| 4,478,467 | 10/1984 | Tyndall | 52/36.1 X |
| 4,624,083 | 11/1986 | Diffrient | 52/239 X |
| 4,874,027 | 10/1989 | Boundy et al. | 52/36.1 X |
| 5,536,080 | 7/1996 | Madimenos et al. | 312/298 X |

OTHER PUBLICATIONS

*Interiours & Sources,* May 1995, (1 page).

*Today's Facility Manager,* "Product of the Month", May 1995 (1 page).

*Architectural Record,* "Teamwork Kit–of–Parts", May 1995 (1 page) p. 46.

*Interiors,* "Products Introduction", May 1995 (2 pages) pp. 130–131.

*Facilities Design & Management,* "Hotline", May 1995 (2 pages) pp. 28–29.

*Contract Design,* May 1995 (1 page).

*Contact Design,* "The Future Arrives–in 1995?", May 1995 (1 page).

*Interior Design,* "Interior Design Market", Jun. 1995 (2 pages) pp. 56–57.

*Haworth Newsline*, "Crossings changes with workers' needs", May 1995 (2 pages).

*Haworth News,* "Crossings Offers New Approach to Work Environment Design" Jun. 1995 (2 pages).

*Interiors,* "Lighting", Nov. 1987, (1 page) p. 66.

*Primary Examiner*—Carl D. Friedman
*Assistant Examiner*—Laura A. Callo
*Attorney, Agent, or Firm*—Flynn, Thiel, Boutell & Tanis, P.C.

[57] ABSTRACT

A self-contained workstation defined by a multi-panel divider wall which defines a workstation area and is closeable by a door assembly hingedly connected thereto. The workstation is readily movable and accessible so as to facilitate repositioning of the workstation as well as opening and closing of the door assembly. The workstation further includes an overhead canopy which is pivotally connected along one edge to the divider wall and extends forwardly therefrom so as to overlie the workstation area which canopy is raisable to adjust vertical clearance within the workstation.

12 Claims, 7 Drawing Sheets

WORKSTATION WITH FLEXIBLE CANOPY

FIELD OF THE INVENTION

This invention relates to a self-contained workstation and, more particularly, to a transportable workstation which includes a multi-panel wall structure defining a workstation area that is enclosed by a door assembly and a flexible overhead canopy.

BACKGROUND OF THE INVENTION

Conventional wall panels are frequently used to subdivide large open office areas into a plurality of individual workstations which are then provided with office components such as work surfaces, shelves and the like. However, to provide more flexibility in office areas and increase interaction between users of these office areas, workstations also are being formed by arrangements of readily movable components such as transportable tables, computer workstations and readily reconfigurable shelf units. Arrangements of such furniture components provide for increased interaction between office workers than that provided by conventional wall panel arrangements that utilize fixed walls which are not readily reconfigurable or movable.

It is therefore an object of the invention to provide a self-contained workstation which defines a workstation area while at the same time facilitates interaction between users of the office area. It is a further object to provide a workstation which is readily accessible and movable while at the same time being enclosable to provide privacy as well as security when not in use. In particular, it is an object to define the workstation by a dividing wall which is connected to a door assembly which door assembly exposes the workstation when opened and fully encloses the workstation after use. It is further desirable that the workstation also be enclosed at an upper end thereof and that the self-contained workstation be readily movable within the office area. Another object is that the workstation accommodate a wide variety of furniture components which are either secured to the workstation itself or are enclosed within the workstation area.

The present invention therefore relates to a self-contained workstation or work nest having a flexible overhead canopy. More particularly, the workstation area is defined by a multi-panel divider wall which in the preferred embodiment has three panels set at a fixed angle of approximately 135 degrees relative to each other. Each panel includes spaced apart vertical uprights preferably joined into a rigid rectangular structure with a solid panel in the bottom third of the wall panel, vertically spaced rigid cross members in the middle third and a perforated metal panel or plexiglass panel in the top third. The divider wall therefore provides a plurality of structures for mounting furniture components and more particularly, includes the vertically spaced cross bars as well as the perforated panels which permit the hanging and connection of furniture components such as shelves, work surfaces or the like.

To provide privacy and security, the divider wall further includes a door assembly connected to one upright post of a divider wall panel which door assembly includes three panel sections hingedly connected one with the other so as to each pivot about a vertical axis independently with respect to the other. The individual door panels generally are arranged in series with a first panel hingedly connected to one side of the divider wall and the remaining second and third door panels extending outwardly therefrom. The door panels are supported in a load-bearing relation with the floor by single casters connected to each of the door panels which facilitates opening and closing of the workstation as well as transport.

A flexible canopy that is supported on a canopy frame is connected to the divider wall which flexible canopy is shaped so as to overlie the enclosed workstation. To vary the angular orientation of the canopy and thereby provide additional vertical clearance within the workstation area, the canopy itself is pivotal about a back edge thereof at its connection to the divider wall so that a front portion of the canopy is raisable and is vertically supported thereat in the raised position by an adjustment assembly connected between the canopy and the divider wall.

To provide for full mobility of the workstation, the divider wall preferably also includes casters which are disposed in load-bearing relation with the floor so that the workstation, for example, when in the closed position, is readily repositionable within the office.

Other objects and purposes of the invention will be apparent to persons familiar with structures of this general type upon reading the following specification and inspecting the accompanying drawings.

Figure 1:
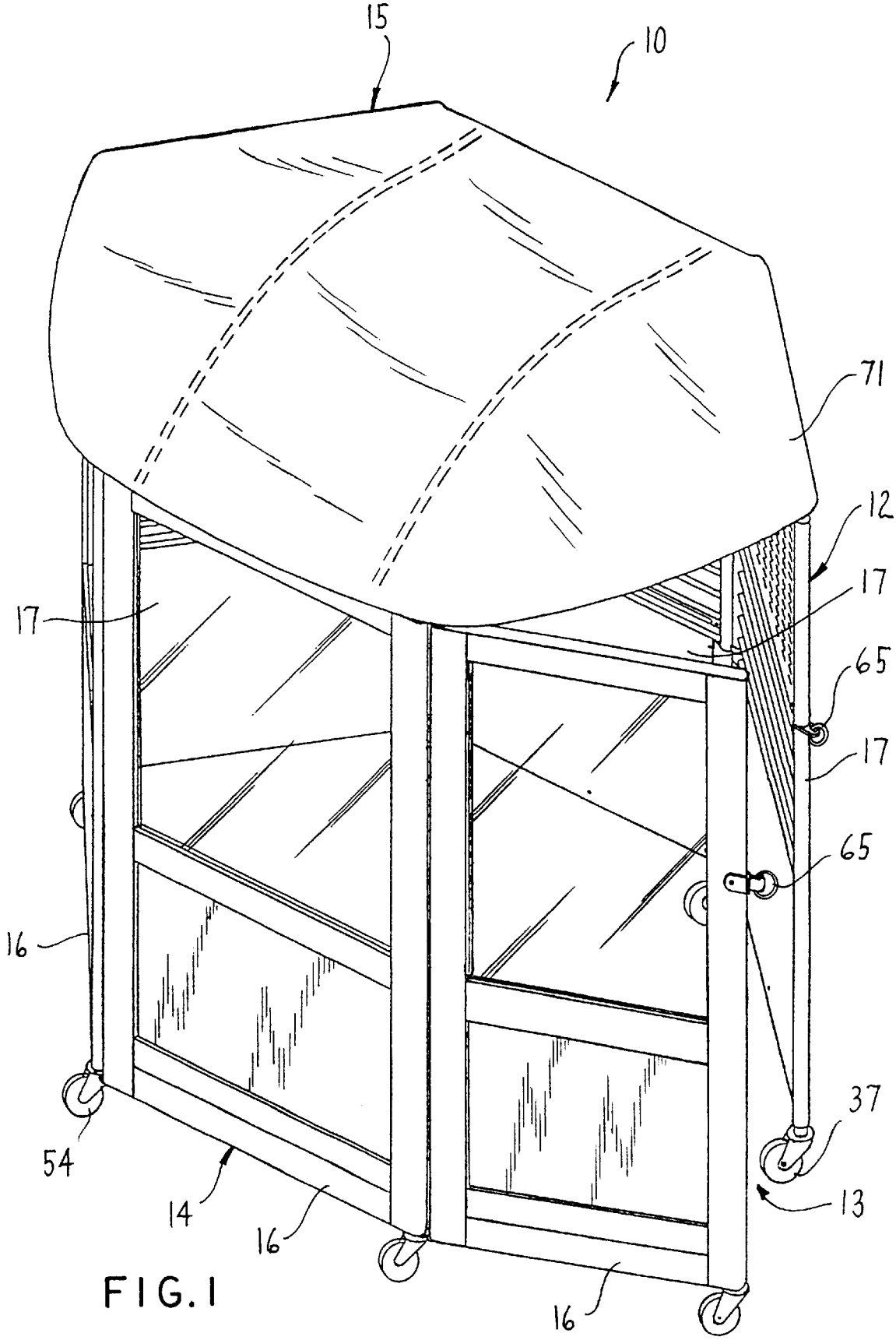
FIG. 1 is a perspective view of the self-contained workstation of the invention having a divider wall, an overhead canopy and a door assembly.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
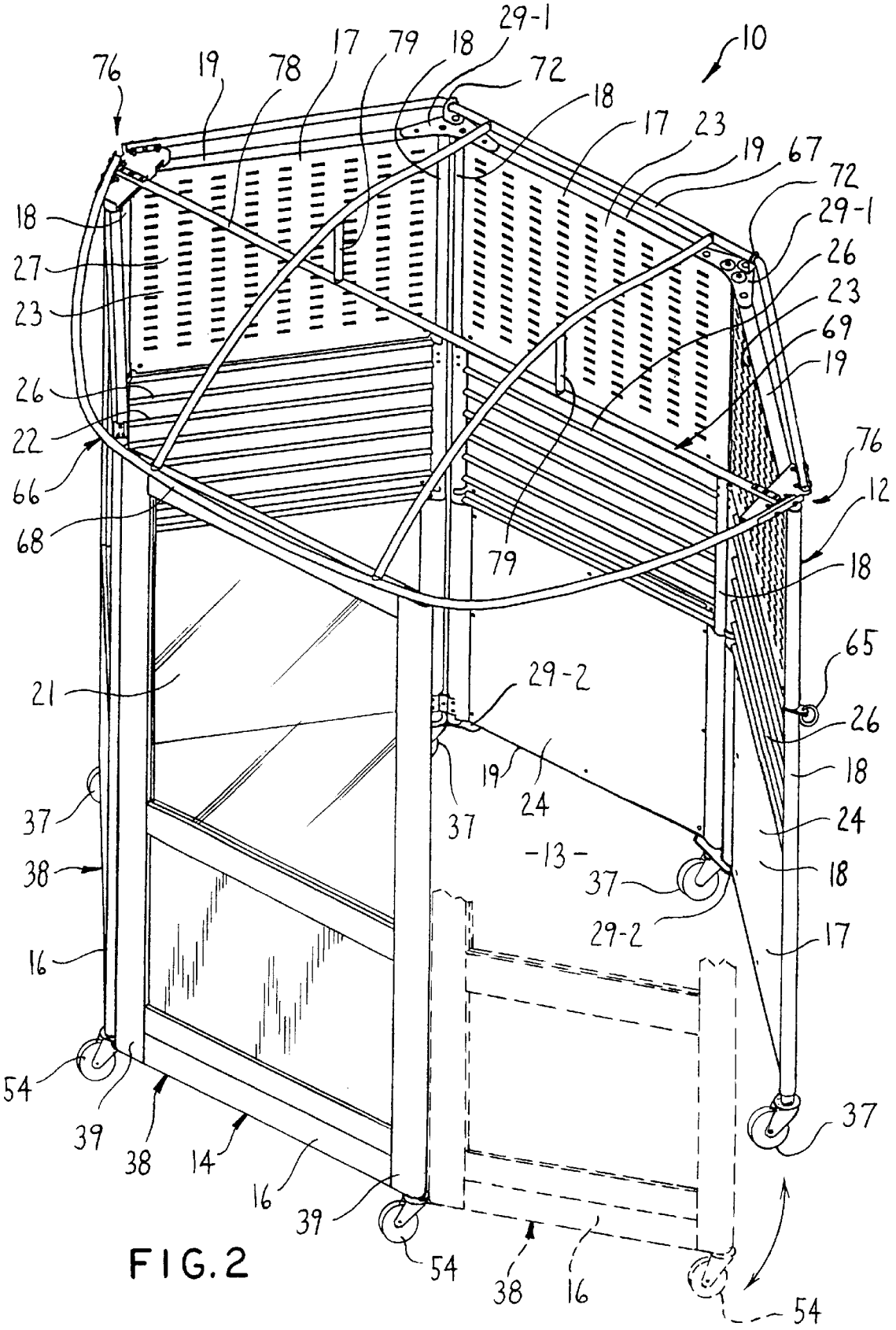
FIG. 2 is a partial perspective view of the workstation of FIG. 1 with the canopy fabric removed and a portion of one door panel illustrated in phantom outline.

Referring to FIGS. 1 and 2, the invention relates to a self-contained workstation or work nest 10 having a multi-panel divider wall or screen 12 which defines a workstation area 13 and includes a multi-panel door assembly 14 hingedly connected along one vertical edge to the divider wall 12. The workstation 10 also includes an overhead canopy assembly 15 which is pivotally connected to the divider wall 12 and overlies the workstation area 13.

Generally, the divider wall 12 has three interconnected freestanding panels 16 to generally define the workstation area 13 and support office components and fixtures therein. Further, the door assembly 14 includes three pivotally connected door panels 16 such that the door assembly 14 is swingable as a unit between open and closed positions while each individual door panel 16 is independently swingable relative to an adjacent door panel 16. To provide privacy while also providing additional overhead clearance, the overhead canopy 15 is pivotally connected to the divider wall 12. Accordingly, the workstation 10 is self-contained, mobile and readily accessible while being readily adaptable to satisfy particular workstation requirements.

More particularly, the divider wall 12 of this workstation arrangement 10, includes three separate and substantially identical upright wall panels 17 (FIG. 2) disposed with adjacent side edges substantially abutting one another so that the panels 17 are effectively joined in series as generally illustrated in FIG. 2. The divider wall arrangement is intended to be stably and self-supportingly positioned on and project vertically upwardly from a support surface such as a floor, and to provide requisite stability where each of the end wall panels 17 are horizontally angularly oriented with respect to the center or intermediate one of the three wall panels 17. Each wall panel 17 generally includes a laterally spaced pair of vertical edge rails 18 which are joined together by laterally extending horizontal top and bottom cross rails 19 that are fixedly joined together to form a generally rectangular fixed frame. The edge rails 18 can be formed as one-piece elements, such as by forming them as elongate hollow cylindrical elements, but for purposes of convenience with respect to manufacture, transport, workstation mobility and reconfiguration, however, it is generally preferable to construct the edge rails 18 as two pieces with an upper section and a lower section.

Each divider wall panel 17 of this invention effectively defines three distinct and unique panel sections, namely a lower panel section 21 which extends upwardly from adjacent the floor, an intermediate panel section 22 which extends generally vertically upwardly from an upper edge of the lower panel section 21, and an upper panel section 23 which extends vertically upwardly from an upper edge of the intermediate section 22. Each of these divider wall panel sections 21, 22 and 23 has a generally rectangular configuration when viewed from the side of the divider wall 12, and in addition each of the panel sections 21, 22 and 23 is of significant height in that each extends vertically over at least about one-fourth of the overall screen height.

Figure 10:
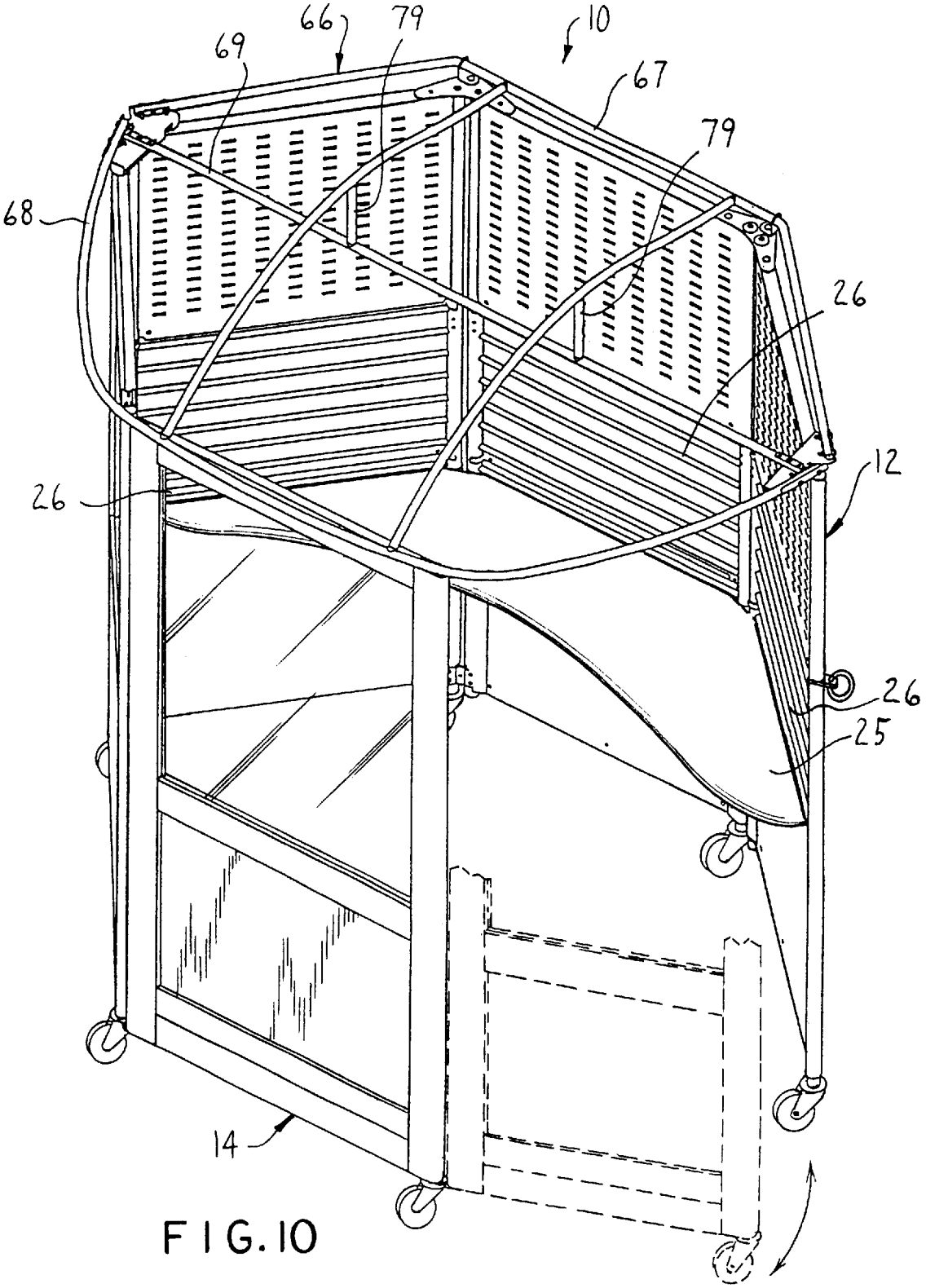
FIG. 10 is a partial perspective view of the workstation illustrating a worksurface supported by the divider wall.

Considering first the lower panel section 21, this section is defined primarily by an enlarged and generally vertically oriented panel or plate 24 which is substantially rectangular and extends horizontally between and is structurally connected to the edge rails 18. The lower panel section 21 is dimensioned so that the upper edge thereof extends to an elevation which is approximately considered to be worksurface or desk height as can be seen with respect to the hanging worksurface 25 (FIG. 10), which is for example disposed at a height of about 28 inches above the floor. The intermediate panel section 22 then projects vertically upwardly from this worksurface height level.

This intermediate panel section 22 is defined primarily by a plurality of horizontally elongate rods 26 which are disposed in parallel but vertically spaced relation one above the other, which rods 26 extend transversely across the divider wall panel 17 so that opposite ends thereof are joined to the respective edge rails 18. These rods 26 are preferably constructed of metal such as steel.

These rods 26 provide a highly useful function for the occupant of the workstation adjacent thereto in that these rods enable a wide variety of auxiliary articles or components, as used in conjunction with the workstation 10, such as the worksurface 25 (FIG. 10), to be hung therefrom so as to not only provide ready accessibility to such components, but also greatly improve the overall flexibility of use and convenience of the workstation. Numerous axillary articles or devices can be hooked onto various ones of the rods 26, which rods thus provide strong and stable support therefor.

Figure 3:
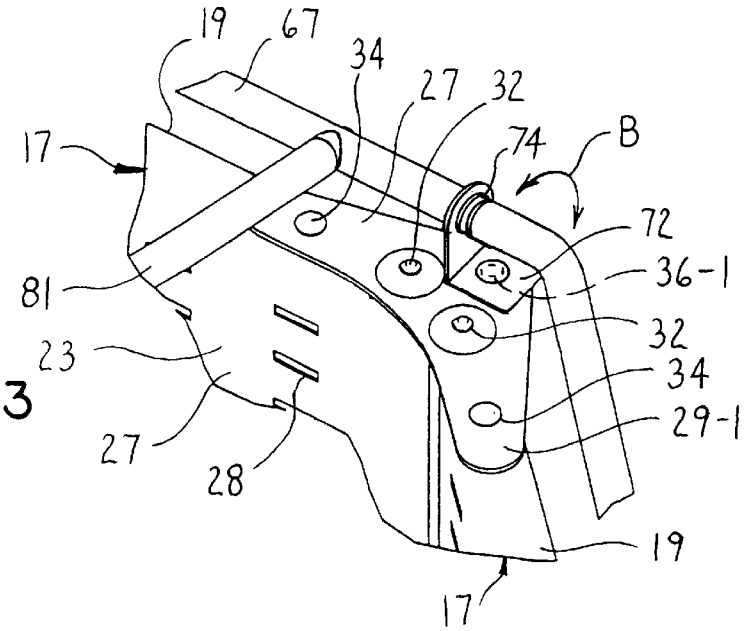
FIG. 3 is an enlarged partial perspective view of a pivot connection between the canopy frame and the divider wall.

Considering now the upper panel section 23, it is defined primarily by a thin perforated plate 27 or plexiglass panel (not illustrated) which is disposed generally in a vertical orientation, and which substantially fills the opening defined horizontally between the edge rails 18. The perforated plate 27 is provided with a large plurality of perforations 28 (FIGS. 2 and 3) extending therethrough, which perforations are disposed in horizontally and vertically aligned rows and columns to define a rectangular grid pattern. The perforations accommodate hooks or the like of hangable furniture components (not illustrated).

To connect one divider wall panel 17 with an adjacent divider wall panel 17 in a fixed angular relation, a boomerang-shaped horizontal connector plate 29-1 extends between and is secured to the top and bottom ends of the respective edge rails 18. More particularly referring to FIG. 3, the connector plate 29-1 includes two spaced apart intermediate apertures that receive fasteners 32 which extend therethrough and project downwardly into openings in the upper ends of the respective edge rails 18 so as to connect the two divider wall panels 17 together. The connector plate 29-1 also includes an additional pair of spaced apart end apertures disposed on the opposite sides of the two intermediate apertures which end apertures receive downwardly projecting fasteners 34 therethrough which fasteners 34 engage slots in the respective top cross rails 19 so as to fixedly secure the connector plate 29-1 to the joined pair of wall panels 17. The leftward fasteners 32 and 34 together define a first horizontal center line extending therethrough which is oriented at an angle of approximately 135 degrees relative to a second horizontal center line extending through the rightward fasteners 32 and 34. Thus, each joined pair of divider wall panels 17 are oriented 135 degrees one with respect to the other. To permit connection of the overhead canopy assembly 15 to the divider wall 12, each connector plate 29-1 also includes an additional threaded aperture 36-1 disposed proximate the apex thereof near the back edge of the connector plate 29-1.

At the lower ends of the divider wall panel 17, similar connector plates 29-2 are joined in an identical manner to the adjacent pair of edge rails 18 so that both the upper and lower ends of each divider wall panel 17 are fixedly secured together. The threaded aperture 36-2 (not illustrated) of each connector plate 29-2, however, receives an upwardly extending threaded shaft (not illustrated) of a caster assembly 37 which caster assemblies 37 thereby support the central divider wall panel 17 in load-bearing relation with the floor. Additional caster assemblies 37 also are engaged with appropriate plates at the lower ends of the outermost edge rails 18 which define the left and right free or opposite ends of the divider wall 12 so that the divider wall 12 is supported by four caster assemblies 37 and is thereby readily movable and repositionable.

Figure 7:
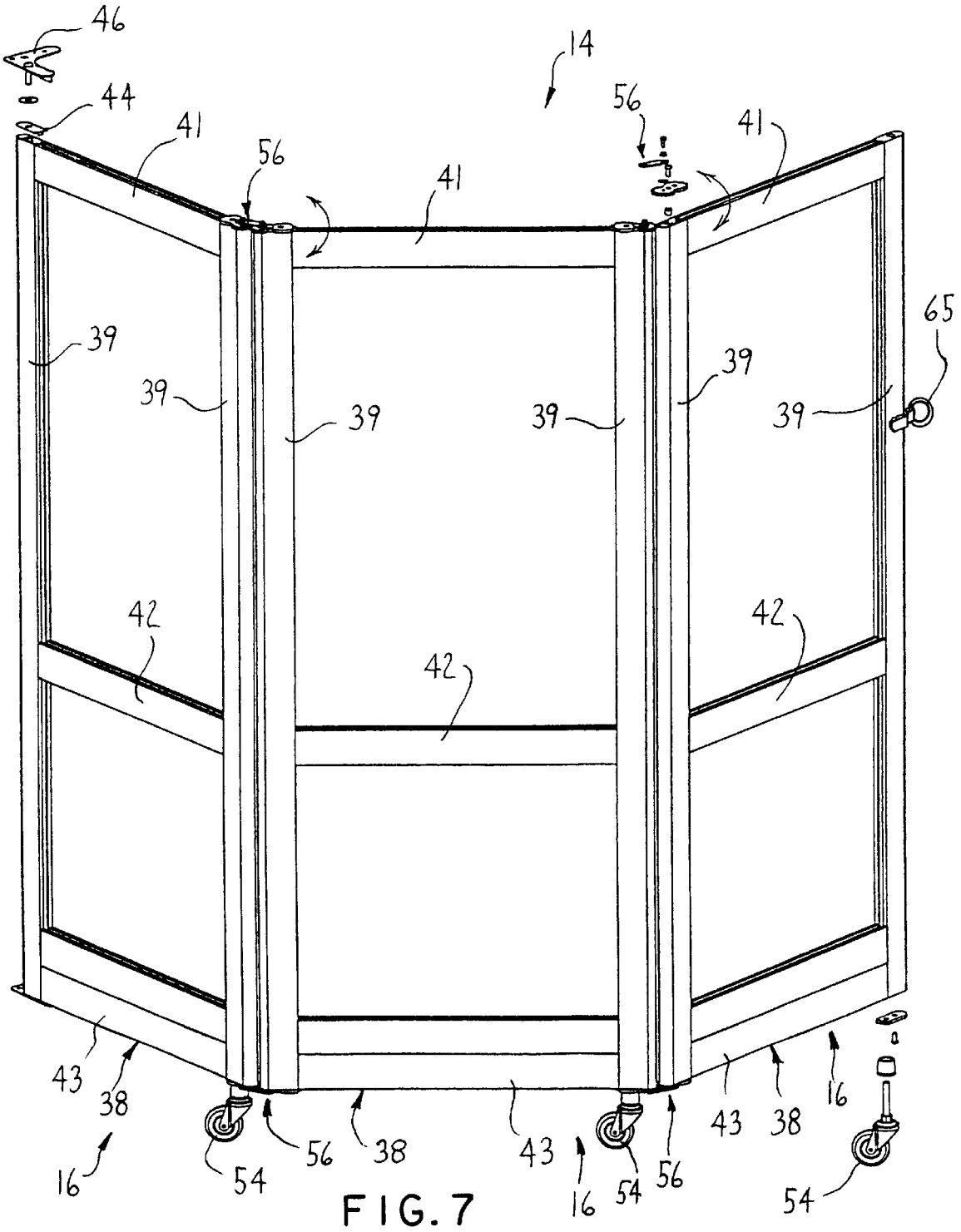
FIG. 7 is a front perspective view illustrating the door assembly of FIG. 1.

To effect closure of the workstation area 13, the door assembly 14 includes a plurality, and preferably three door panels 16 (FIGS. 2 and 7). The door panels 14 include door panel frames 38 each defined by a pair of vertically extending edge rails 39 which are joined together by upper, intermediate and lower horizontal cross rails 41, 42 and 43, the opposite ends of which are connected to the interior edges of the edge rails 39 so as to define a rigid generally rectangular frame. The open areas between the edge rails 39 and the horizontal rails 41, 42 and 43 are typically enclosed by a solid sheets of metal, glass or other material or combinations thereof.

Figure 8:
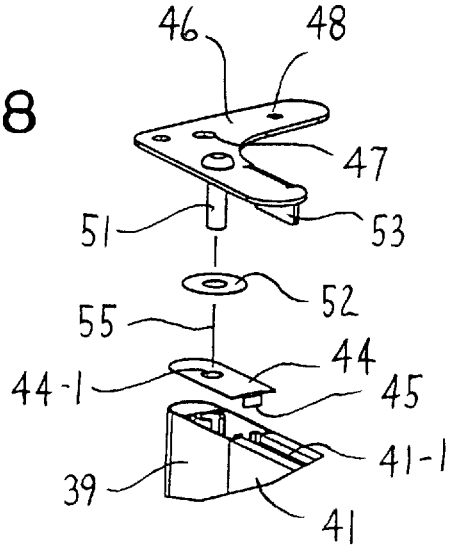
FIG. 8 is an enlarged partial perspective view illustrating a pivot assembly connecting the leftward door panel to the divider wall.

Referring to FIGS. 7 and 8, the door assembly 14 is pivotally connected to one free end of the divider wall 12 and in particular to the edge rail 18 located thereat. The pivoted leftward edge rail 39 of the end door panel frame 38 includes a mating plate 44 which closes the open top end of the edge rail 39 and includes a downwardly depending tab 45 seated in a horizontal channel 41-1 formed in the upper cross rail 41. To positively connect the door assembly 14 and divider wall 12 together, a pivot bracket 46 is provided which has a generally right angle and has an intermediate aperture 47 and an end aperture 48 which each receive a fastener 49 therethrough for connection to the top cross rail 19 of the divider wall panel 17 to which the door assembly 14 is being connected. To permit pivoting movement, a pivot pin 51 is inserted through an additional aperture formed through the pivot bracket 46 and joined thereto which pivot pin 51 extends downwardly into rotatable engagement with an aperture 44-1 (FIG. 8) of the door mating plate 44. A washer 52 is also provided therebetween to facilitate pivoting movement.

Figure 5:
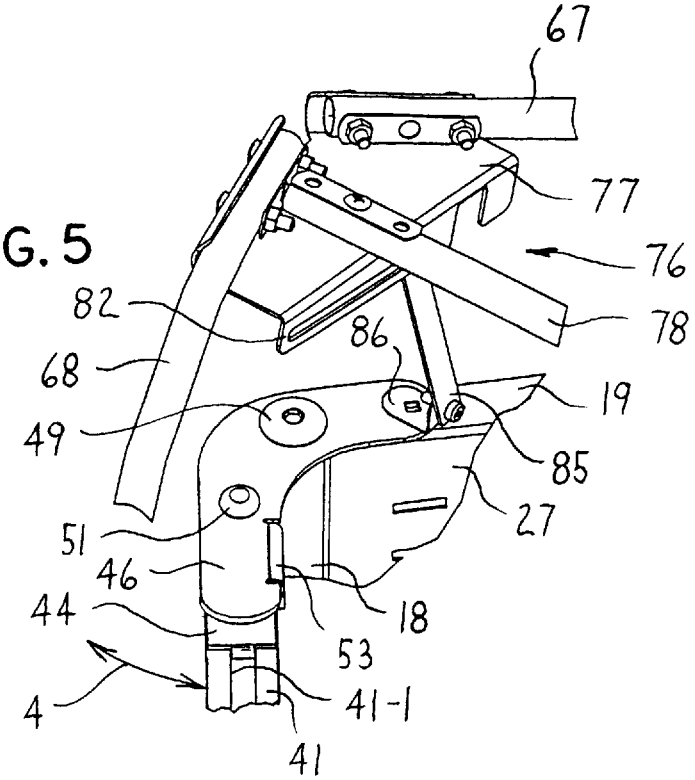
FIG. 5 is an enlarged partial perspective view of a left-side height adjustment mechanism.

The pivot bracket 46 further includes a downwardly extending stop flange 53 which defines a limit position for restricting pivoting movement of the door assembly 14 toward the interior of the divider wall 12. In particular, the door assembly 14 is able to pivot about the pivot pin 51 along an angular path which extends away from the stop flange 53. A similar pivot bracket 46 is also connected to the lower end of the edge rail 39 to provide a second connection location whereby a vertical pivot axis 55 extends through the upper and lower pivot pins 51 such that the door 14 is swingable as a unit generally along the angular path identified by reference arrow A (FIG. 5). The leftward door panel frame 38 further includes a caster assembly 54 at the outward swinging end thereof while the opposite end is vertically supported by the connection of the pivot brackets 46.

Referring to FIG. 7, a center or intermediate one of the three door panels 16 is connected to the above-described leftward door panel 16 while the additional rightward door panel 16, which defines a free end of the door assembly 14, is connected to the center door panel 16 which connections use substantially identical connection assemblies 56 described as follows.

Figure 9:
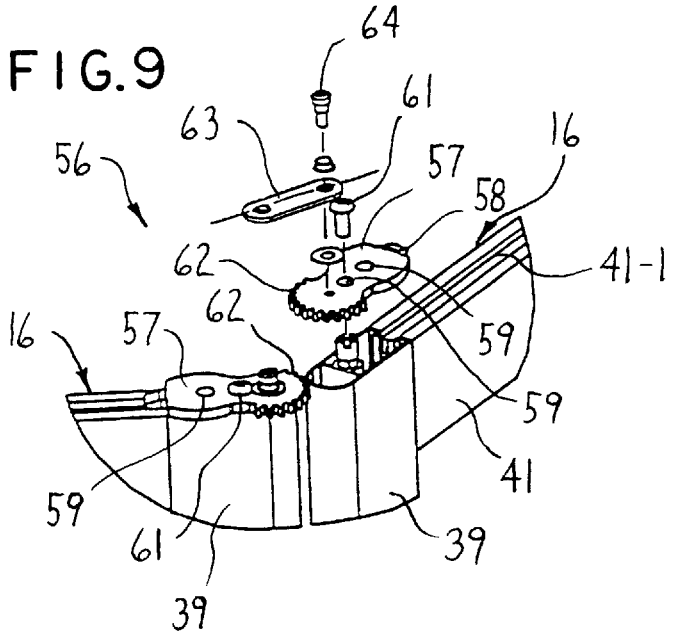
FIG. 9 is an enlarged partial perspective view illustrating an upper connector assembly for the pivotal connection of two serially adjacent door panels one with the other.

Referring to FIG. 9, the door panel connection assembly 56 includes an engagement plate 57 which includes a tab 58 at one end that seats in the channel 41-1 of the top door rail 41, and a central aperture 59 which receives a fastener 61 therethrough for fastening the engagement plate 57 onto the upper end of the vertical edge rail 39. The engagement plate 57 further includes a semi-circular arrangement of gear teeth 62 at the other end thereof which are adapted to engage corresponding gear teeth 62 on an adjacent engagement plate 57 of the door panel 16 adjacent thereto. To fixedly secure the two door panels 16 together, a tie bar 63 having apertures at the opposite ends thereof is aligned with respective pivot bores 59 of the cooperating engagement plates 57 which each non-releasably receive a spaced apart pivot pin 64 therethrough for rotatable engagement with the edge rails 39. The tie bar 63 serves to pivotally connect the two door panels 16 together while the cooperating gear teeth 62 limit the pivoting movement of one door panel 16 relative to the other so that each door panel 16 can only swing about a vertical pivot axis which passes through the contact location between the gear teeth 62. A similar connection assembly 56 is provided on the lower ends of the edge rails 39 being joined. The connector assembly 56 therefore is provided in four locations, namely at the upper and lower connections of the first and second door panels 16 and at the upper and lower connections between the second and third door panels 16. Thus, the entire door assembly 14 not only pivots or swings about the first vertical pivot axis between the door assembly and the divider wall 12 but also about second pivot axes between adjacent pairs of door panels 16. Additionally, by way of the connector assemblies 56, the caster assemblies 37 vertically support not only the door panel 16 to which they are connected but also the adjacent end of the door panel 16 that is pivotally connected thereto. The above pivotal connections between the three door panels also permit the door panels to relatively swing substantially 360 degrees so that the three panels are positioned generally in adjacent and overlapping relation to permit compact storage when the door is open.

To effect locking of the door assembly 14 in the closed position illustrated generally in FIG. 2, the outermost end of the door assembly 14 and in particular, the free end of the outermost third door panel 56 includes a locking ring 65 secured to the edge rail 39 while a further locking ring 65 is connected to the adjacent rightward edge rail 18 of the divider wall panel 17 which locking rings 65 are disposed close together when the door assembly 14 is closed and lockable one with the other by an appropriate lock, such as a padlock. When the door assembly 14 is in the closed position, the workstation 10 when viewed from above generally defines a hexagonal geometric shape that stores office components such as tables, chairs or the like as well as hanging components within the workstation area 13.

To fully enclose the workstation area 13, the overhead canopy assembly 15 includes a canopy frame 66 which is attached to the center most divider wall panel 17 so as to overlie the workstation area 13. More particularly, the canopy frame 66 has a shape, when viewed from above, which generally corresponds to the hexagonal shape defined by the divider wall 12 and the door assembly 14.

Referring to FIGS. 1 and 2, the canopy frame 66 generally includes a rear frame member 67 extending around the top edge of the divider wall 12, a front frame member 68 which bows forwardly away from the divider wall 12 and extends generally along the top edge of the door assembly 14 when closed, and an interior truss-like frame structure 69 which further supports the rear and front frame members 67 and 68 as well as a canopy fabric 71.

The rearward frame member 67 is preferably manufactured from metal tubing and is bent at two locations so as to correspond to the shape of the divider wall 12 and in particular, to have left, center and right sections which are fixed at an angle approximately 135 degrees relative to the other. The rearward frame member 67 is secured to the divider wall 12 and in particular, to the boomerang-shaped connector plates 29-1 which hold the adjacent divider wall panels 17 together. A right-angled pivot bracket 72 (FIG. 3) is fastened to the threaded aperture 36-1 so that a vertical leg thereof which defines a horizontally opening aperture is connected thereto which pivot bracket 72 includes a bushing 74 snapped into the aperture for pivotally receiving the rearward frame member 67 therethrough proximate its bent portions. Plastic push in bottoms or canoe clips are snapped into the rear frame member 67 on opposite sides of the bushing 74 to locate the frame member 67 relative thereto. A similar pivot bracket 72 is also fastened to the other of the connector plates 29 so that the rearward frame member 67 is connected at two locations to the divider wall 12 and is pivotable (as generally indicated by reference arrow B) about a horizontal axis defined by the axes of the pivot bracket apertures. Thus the opposite distal ends of the rear frame member 67 are able to pivot about this horizontal axis.

Figure 6:
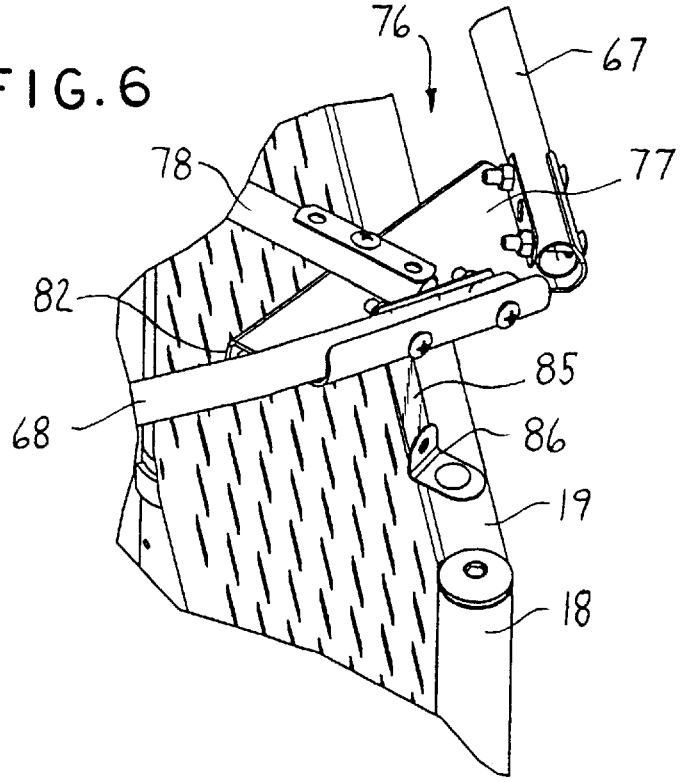
FIG. 6 is an enlarged partial perspective view of a right-side height adjustment mechanism.

The front frame member 68 is secured to the opposing opposite ends of the rearward frame member 67 by an adjustment assembly 76 and in particular, adjustment brackets 77 thereof as seen in FIGS. 5 and 6. The adjustment bracket 77 also connects to a horizontal frame member 78 of the interior frame 69 which extends laterally between the spaced apart adjustment brackets 77. The interior frame 69 generally defines a supporting truss for the canopy fabric 71 and includes upright frame members 79 which extend vertically from the central portion of the horizontal frame member 78 which upright frame members 79 have their upper ends connected to respective upwardly bowed arcuate frame members 81 which are connected at their rear ends to the rearward frame member 67 in the region between the pivot brackets 72 and at their forward ends to a central portion of the frontward frame member 68. The construction of the interior frame 69 uses suitable fasteners and preferably wedge tube connectors which secure the ends of a particular frame member with a transversely oriented sidewall of another frame member. Thus, the entire frame 66 of the canopy assembly 15 is pivotal about the horizontal axis.

The canopy assembly 15 normally is vertically supported in a lowered position by the adjustment brackets 77 which are disposed in a load-bearing relationship with the edge rails 18 of the left and right end wall panels 17 but is also raisable upwardly to and lockable in a raised position.

Figure 4:
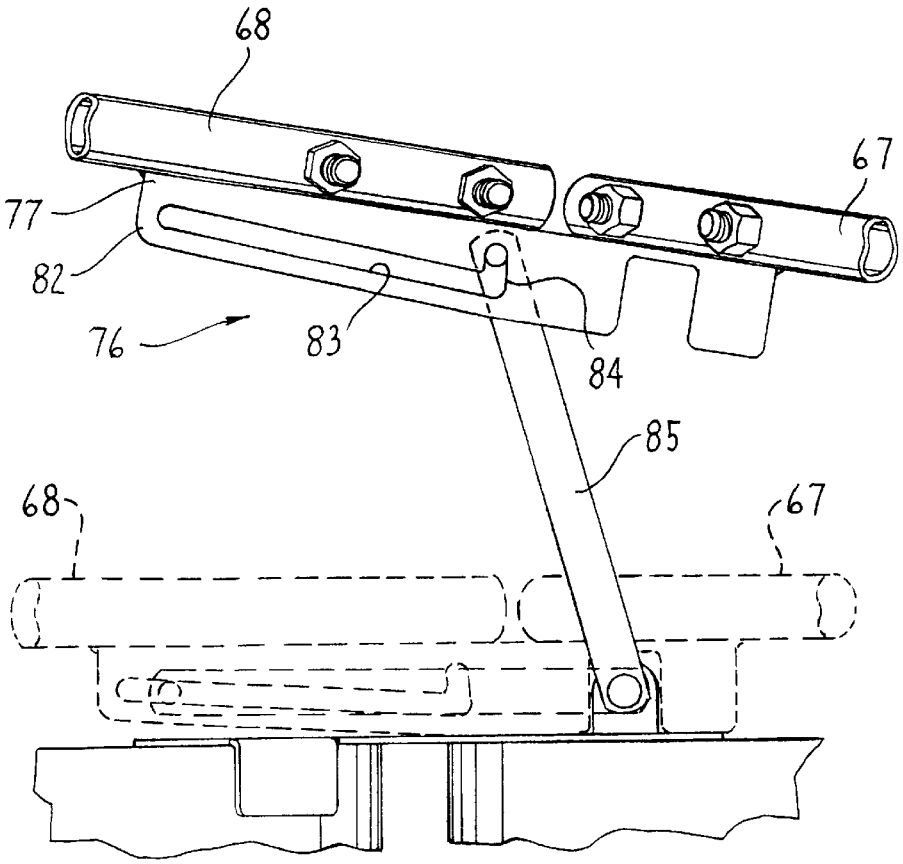
FIG. 4 is a partial side elevational view illustrating an adjustment mechanism for the canopy with the canopy frame illustrated in a raised position in solid lines and in a lowered position in phantom outline.

To permit this pivoting movement between the lowered position supported on the divider wall 12 and the raised position disposed upwardly therefrom (see FIGS. 5 and 6), each adjustment bracket 77 includes a downwardly depending slide flange 82 which includes a generally horizontal elongate slot or track 83 along a substantial length thereof. As seen in FIG. 4, the rearward end of the slot 83 includes a generally vertical leg 84 thereof which extends upwardly at a right angle from the rearward end of the slot 83.

The adjustment assembly 76 further includes a plate-like elongate support bar 85 which has an upper end slidably connected to the slot 83 by a horizontal pin and has an opposite lower end pivotally connected to the upper divider wall rail 19 by a right angle bracket 86. In the left assembly (FIG. 5), the bracket 86 is fastened to the divider wall 12 by a fastener extending through the end aperture of the pivot bracket 46 while on the right side (FIG. 6), the bracket 86 is fastened directly to a corresponding slot in the top rail 19. When raising and lowering the canopy frame 66, the upper end of the support bar 85 slides along the slot 83 which support bar 85 is then engaged within the vertical leg 84 so as to prevent sliding movement and secure the canopy frame 66 in the raised position illustrated in solid lines in FIG. 4.

The canopy fabric 71 is of a thin and flexible sheetlike material which is secured to the canopy frame 66 and in particular, is formed of a suitable stretchable fabric, which is secured to the canopy frame 66 by suitable loops and sleeves that slide over the rearward and front frame members 67 and 68, and is thereby stretched over and supported by the interior frame 69. The canopy fabric thus assumes an upwardly bowed configuration due to its support on the frame 66. The canopy fabric 71 preferably includes flaps in the region of the adjustment assemblies 76 which allow the fabric 71 to be slid onto the canopy frame 66 while allowing fastening of the frame members 67 and 68 to the adjustment brackets 76 with suitable fasteners and plates. The flaps have connectors such as snaps so that the flaps cover the adjustment assemblies 76 once assembled. Additionally, the fabric 71 includes slits near the connections between the interior frame 69 and the front and rear frame members 67 and 68 to allow access to fasteners or wedge connectors.

The canopy fabric desirably has a surface characteristic which is highly light reflective so as to facilitate reflection of ambient light within the work nest. This canopy fabric also preferably has at least limited translucency to permit ceiling light, if available, to at least partially pass through the fabric into the work nest.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A self-contained workstation comprising:

a divider wall comprising at least three upright divider wall panels disposed in a serially adjacent relationship and positioned in upright supportive engagement on a floor, said divider wall panels having a horizontal width defined between generally parallel and vertically extending side edges and being serially connected together to define first and second opposite divider wall ends, the side edge of one said divider wall panel and the side edge of another adjacent said divider wall panel being positioned closely adjacent one another, each adjacent pair of said side edges being non-separably joined together at a fixed predetermined angle one with respect to the other by a mounting member having opposite ends fixedly connected respectively to said adjacent divider wall panels;

a door assembly which includes at least three door panels disposed in serially adjacent relationship and positioned in upright supportive engagement on a floor, said door panels having a horizontal width defined between generally parallel and vertically extending side edges and being serially connected together to define a pivot end and an opposite free end of said door assembly, the combined width of the door panels at least equal to the distance extending laterally between said first and second divider wall ends, said pivot end being pivotally connected to said first divider wall end so that said door assembly is swingable relative to said divider wall about a first vertical axis between open and closed positions, each adjacent pair of said door panels being pivotally connected together to define a second pivot axis therebetween so that each said door panel is independently swingable relative to an adjacent said door panel, said door assembly having at least two of said second pivot axes, said free end having connector means for removably connecting said free end to said second divider wall end when in said closed position, said connector means being releasable to permit said free end to be swung away from said second divider wall end by pivoting of either said door assembly about said first pivot axis, or said door panels about one or both of said second pivot axes; and a horizontally enlarged canopy assembly which overlies a top end of said workstation so as to cover a workstation area defined by the divider wall and the closed door assembly, said canopy assembly including a canopy frame formed of elongate rods which is connected to an upper end of the divider wall and supports a canopy fabric thereon, a rear edge portion of said canopy frame being pivotally connected to said divider wall by at least two spaced apart pivot members which are secured to said upper end of said divider wall, said canopy frame being pivotable vertically between lowered and raised positions about a horizontal pivot axis defined by said pivot members, said pivot axis extending along a top edge of an intermediate one of said wall panels between said opposite side edges thereof.

2. The workstation according to claim 1, wherein said canopy frame extends forwardly from said rear edge portion in a cantilevered relation from said divider wall and includes a front edge portion which extends forwardly to said closed door assembly, said canopy frame having a lower surface disposed in load bearing engagement on said divider wall when in said lowered position.

3. The workstation according to claim 2, wherein said canopy frame includes adjustment means connected between said canopy frame and said divider wall for permitting said pivoting between said raised and lowered positions and releasably fixing said canopy frame in said raised position.

4. The workstation according to claim 1, wherein said adjacent pair of door panels pivotally connected together includes a connector assembly joined between respective said side edges thereof which connector assembly defines said second pivot axis, one said side edge of said adjacent pair of door panels being supported in rolling engagement with the floor by a wheel assembly extending downwardly therefrom and an adjacent side edge pivotally connected thereto being supported above the floor by said connector assembly.

5. The workstation according to claim 1, wherein said canopy frame is pivotable through an acute angle upwardly to said raised position such that a substantial portion of said workstation area remains covered by said canopy assembly when moved to said raised position.

6. A self-contained workstation comprising:

a divider wall comprising at least three upright divider wall panels which are serially connected together to define first and second opposite divider wall ends and are positioned in upright supportive engagement on a floor, each said divider wall panel having a horizontal width defined between generally parallel and vertically extending side edges, the side edge of one said divider wall panel and the side edge of another adjacent said divider wall panel being positioned closely adjacent one another, each adjacent pair of said side edges being non-separably joined together at a fixed predetermined angle one with respect to the other by a rigid mounting member having opposite ends fixedly connected respectively to said adjacent divider wall panels;

a door assembly which includes a plurality of door panels serially connected together to define a pivot end and an opposite free end and positioned in upright supportive engagement on a floor by downwardly directed caster assemblies, said door panels having a horizontal width defined between generally parallel and vertically extending side edges, the combined width of said door panels being at least equal to the distance extending laterally between said first and second divider wall ends, said pivot end being pivotally connected to said first divider wall end so that said door assembly is swingable as a unit about a first vertical axis between open and closed positions; said adjacent side edges of said adjacent door panels being pivotally connected so that each said door panel is independently swingable about a second vertical pivot axis defined between said adjacent side edges, said free end having connector means for removably connecting said free end to said second divider wall end when in said closed position; and a horizontally enlarged canopy assembly which overlies a top end of said workstation so as to cover a workstation area defined by the divider wall and the closed door assembly, said canopy assembly including a canopy frame formed of elongate rods, a rear edge portion of said canopy frame being pivotally connected to an upper end of the divider wall and supporting a canopy fabric thereon, said canopy frame being connected to said mounting members by pivot means for defining a horizontal pivot axis, said horizontal pivot axis extending between the opposite side edges of an intermediate one of said wall panels along an upper edge thereof, said canopy frame being vertically swingable about said horizontal pivot axis between a lowered position vertically supported by said divider wall and a raised position disposed upwardly therefrom, said canopy assembly being pivoted through an acute angle upwardly to said raised position such that a substantial portion of said workstation area remains covered by said canopy assembly when moved to said raised position.

7. The workstation according to claim 6, wherein said pivot means is a pair of pivot brackets mounted to said mounting members to which said canopy frame is pivotally connected, said canopy frame being vertically swingable about said horizontal pivot axis which extends through said pivot members.

8. The workstation according to claim 7, wherein said canopy frame extends forwardly from said rear edge portion and is disposed in load bearing engagement at least on said side edges at said first and second opposite divider wall ends.

9. The workstation according to claim 8, wherein said canopy frame includes adjustment means connected between said canopy frame and at least one of said first and second opposite divider wall ends for permitting said pivoting between said raised and lowered positions and releasably fixing said canopy frame in said raised position.

10. A self-contained workstation comprising:

a divider wall comprising at least three serially-connected upright divider wall panels positioned in upright supportive engagement on a floor, said divider wall panels having parallel vertically extending side edges which are laterally spaced to define a horizontal width of each said divider wall panel, the side edge of one said divider wall panel and the side edge of another said divider wall panel being positioned closely adjacent one another and-fixedly connected together in a fixed angular relation by a mounting member extending therebetween, at least an intermediate one of said divider wall panels being disposed between first and second said divider wall panels which define opposite first and second ends of said divider wall assembly, said first and second divider wall panels extending at an angle forwardly relative to said intermediate divider wall panel adjacent thereto to define a rear boundary of a workstation area, said side edges of said first and second divider wall panels which are disposed away from said intermediate divider wall panel defining an open front of said workstation area;

a door assembly which includes a plurality of door panels serially connected together, said door assembly being pivotally connected to said first end of said divider wall assembly to selectively enclose said open front when in a closed position and being positioned in upright supportive engagement on a floor, said door panels having parallel vertically extending side edges which are laterally spaced apart, the side edge of one said door panel and the side edge of another laterally adjacent said door panel being fixedly connected together by connector means for defining a first vertical pivot axis about which said adjacent door panels are independently pivotable, at least an intermediate one of said door panels being disposed between first and second said door panels which said first and second door panel respectively define a pivot end and an opposite free end of the door assembly, said pivot end and said first divider wall end being pivotally connected together by pivot connector means so that said door assembly is swingable as a unit about a second vertical pivot axis between an open position and said closed position, said free end having connector means for removably connecting said free end to said second divider wall end when in said closed position; and a horizontally enlarged canopy assembly which overlies a top end of said workstation so as to cover the workstation area defined by the divider wall and the closed door assembly, said canopy assembly including a canopy frame formed of elongate rods which includes a rear frame member disposed in a load-bearing relation with the divider wall, a front frame member having opposite ends connected to said rear frame member by first and second frame connectors proximate said first and second opposite ends of said divider wall and being cantilevered therefrom so as to extend forwardly over said door assembly when in said closed position generally along a top edge thereof, an intermediate frame assembly being connected to said front and rear frame members to support a canopy fabric thereon, said intermediate frame assembly having at least one first support member extending forwardly between said front and rear frame members, and at least one second transverse member extending horizontally between said first and second frame connectors and connected to said first support member, said rear frame member of said canopy frame being pivotally connected to pivot members secured on each said mounting member of said intermediate divider wall so as to be pivotally supported at two locations, said canopy frame being vertically swingable about a horizontal pivot axis which is defined by said pivot members and extends along a top edge of said intermediate divider wall panel between the opposite side edges thereof.

11. The workstation according to claim 10, wherein the opposite ends of said front and rear frame members are connected together by said first and second frame connectors which are disposed in load bearing engagement at least on said side edges of said divider wall panels disposed at said first and second opposite divider wall ends.

12. The workstation according to claim 10, wherein said canopy frame includes adjustment means connected between said canopy frame and at least one of said first and second opposite divider wall ends for permitting said pivoting between said raised and lowered positions and releasably fixing said canopy frame in said raised position.

* * * * *

UNITED STATES PATENT AND TRADEMARK OFFICE

CERTIFICATE OF CORRECTION

PATENT NO. : 5 802 778

DATED : September 8, 1998

INVENTOR(S) : Clarkson S. THORP et al

It is certified that error appears in the above-identified patent and that said Letters Patent is hereby corrected as shown below:

Column 10, line 8; change "positions;" to
-positions,---; and
line 63; change "and-fixedly" to -and
fixedly---.

Signed and Sealed this

Twentieth Day of April, 1999

*Attest:*

Q. TODD DICKINSON

*Attesting Officer*

*Acting Commissioner of Patents and Trademarks*